US006324869B1

(12) United States Patent
Vanlioglu

(10) Patent No.: US 6,324,869 B1
(45) Date of Patent: Dec. 4, 2001

(54) SYSTEM AND METHOD FOR ENHANCING THE VIEWED BRIGHTNESS OF PRECIOUS OR SEMI-PRECIOUS STONES

(75) Inventor: Murat Vanlioglu, Istanbul (TR)

(73) Assignee: Vanli Kuyumculuk Sanayi ve Ticaret Limited Sirketi (TR)

( * ) Notice: Subject to any disclaimer, the term of this patent is extended or adjusted under 35 U.S.C. 154(b) by 0 days.

(21) Appl. No.: 09/385,126

(22) Filed: Aug. 27, 1999

(30) Foreign Application Priority Data

Jul. 13, 1999 (TR) ..... a 1999 01640

(51) Int. Cl.[7] ..... A44C 17/02
(52) U.S. Cl. ..... 63/31; 63/26; 63/28
(58) Field of Search ..... 63/26, 28, 31

(56) References Cited

U.S. PATENT DOCUMENTS

| | | | | |
|---|---|---|---|---|
| 2,022,936 | * | 12/1935 | Kip, Jr. | 63/15 |
| 2,258,413 | * | 10/1941 | Koven | 63/31 |
| 4,208,888 | * | 6/1980 | Erdman et al. | 63/3 |
| 4,294,084 | * | 10/1981 | Lampert | 63/15 |
| 4,796,442 | * | 1/1989 | Sarcona | 63/26 |
| 5,454,234 | * | 10/1995 | Karmeli | 63/28 |
| 5,632,164 | * | 5/1997 | Bergagnini | 63/23 |

FOREIGN PATENT DOCUMENTS

| | | | | |
|---|---|---|---|---|
| 653227 | * | 12/1985 | (CH) | 63/26 |
| 3816665 | * | 12/1988 | (DE) | 63/26 |
| 2306650 | * | 5/1976 | (FR) | 63/26 |
| 2491307 | * | 4/1982 | (FR) | 63/26 |
| 170473 | * | 8/1951 | (NO) | 63/26 |

* cited by examiner

*Primary Examiner*—B. Dayoan
*Assistant Examiner*—Andrea Chop
(74) *Attorney, Agent, or Firm*—Harrison & Egbert

(57) ABSTRACT

A system and method utilizing a display apparatus for enhancing the viewed brightness of a precious or semi-precious stone. The system and method includes a display container having an outer body, a back cover, a transparent front cover located a distance from the back cover, at least one metal bearing having a facetted exterior lower surface and sized to fit within the container between the back cover and the front cover. The metal bearing is adapted to pin or nail a precious or semi-precious stone thereby retaining the stone and the height of the metal bearing and stone is less than the distance between the front and back covers. The distance between the front and back covers is such that the stone containing metal bearing is able to rock or tilt from side to side without falling completely on its side.

4 Claims, 7 Drawing Sheets

SYSTEM AND METHOD FOR ENHANCING THE VIEWED BRIGHTNESS OF PRECIOUS OR SEMI-PRECIOUS STONES

FIELD OF THE INVENTION

This invention relates to the general field of a display apparatus for enhancing the appearance of precious or semi-precious stones. More specifically, this invention relates to a system and method utilizing a display apparatus for enhancing the viewed brightness of a precious or semi-precious stone.

BACKGROUND OF THE INVENTION

Precious or semi-precious stones are known for their brightness. When displaying precious or semi-precious stones it is desired that the stones are displayed in such a manner as not to decrease the brightness of the stone. In the prior art systems for displaying precious or semi-precious stones, the location of metals around the stones detracts from the performance or brightness of the stone. In addition, in prior art systems, the stones are prevented from leaning or tilting from side to side. The need remains in the art for an improved system and method for displaying precious or semi-precious stones such that the brightness of the precious stone is enhanced rather than diminished. The need remains in the art for an improved system and method for displaying precious or semi-precious stones that allows the stones to tilt and lean from side to side.

SUMMARY OF THE INVENTION

A preferred embodiment of the present invention display system for enhancing the brightness of precious or semi-precious stones includes the following:

(a) a display container including an outer body, a back cover, and a transparent front cover located a distance from the back cover;

(b) at least one metal bearing having a cup shape including an open cavity front surface having a maximum width, sidewalls, a rounded, facetted exterior lower surface, and a bearing height, with at least one metal bearing sized to fit within the container between the back cover and the front cover with the lower surface adjacent the back cover and the front surface adjacent said front cover, with at least one metal bearing adapted to receive and retain a precious or semi-precious stone;

(c) at least one precious or semi-precious stone nailed or pinned by at least one metal bearing; and (d) wherein the distance between the front and back covers is less than the maximum width across the open cavity front surface and greater than the bearing height.

In an alternative embodiment of the present invention, the display container includes a waterproof seal.

DETAILED DESCRIPTION OF THE INVENTION

Figure 1:
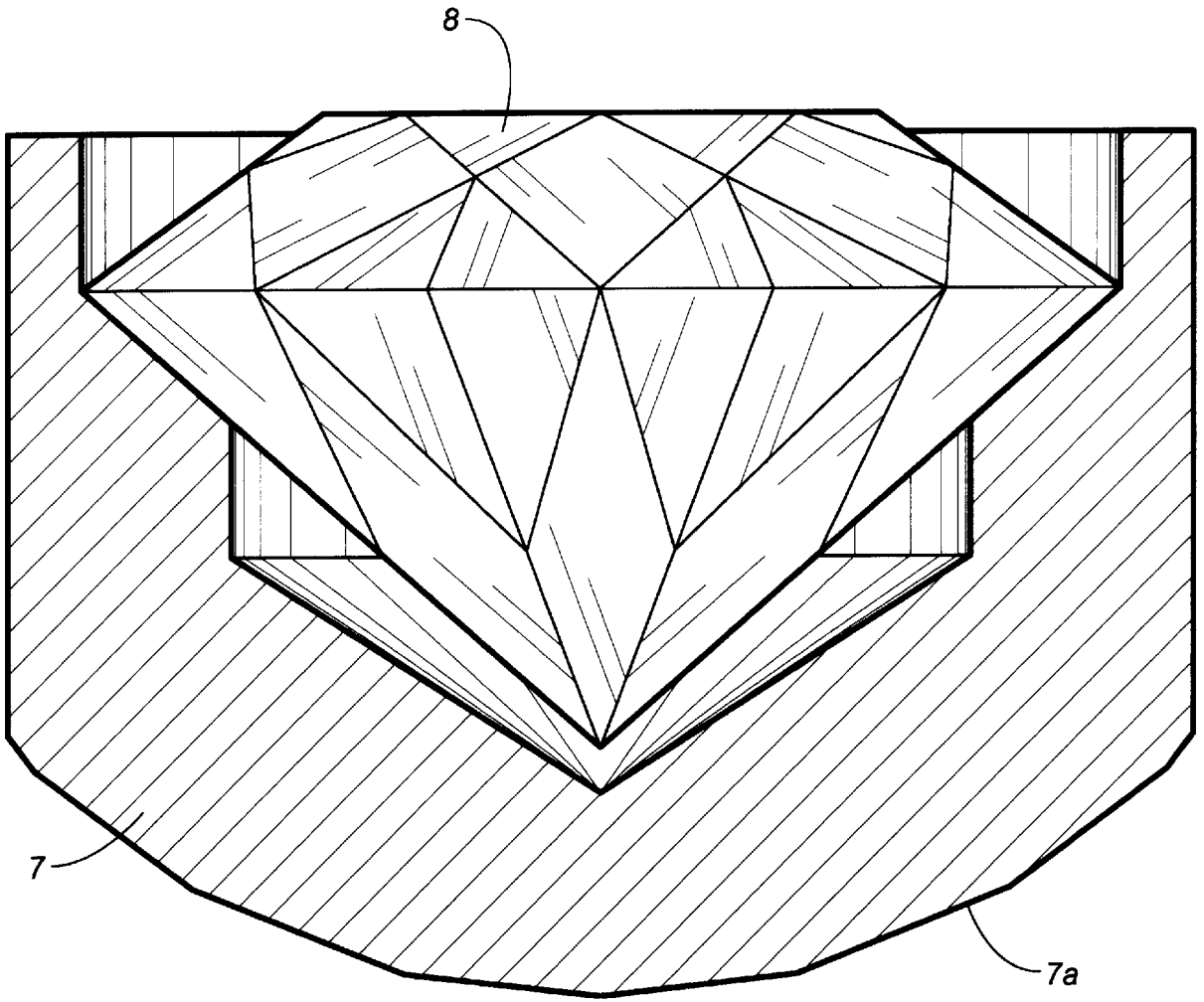
FIG. 1 is an elevation view of a precious or semi-precious stone pinned or nailed by a metal bearing.
Figure 2:
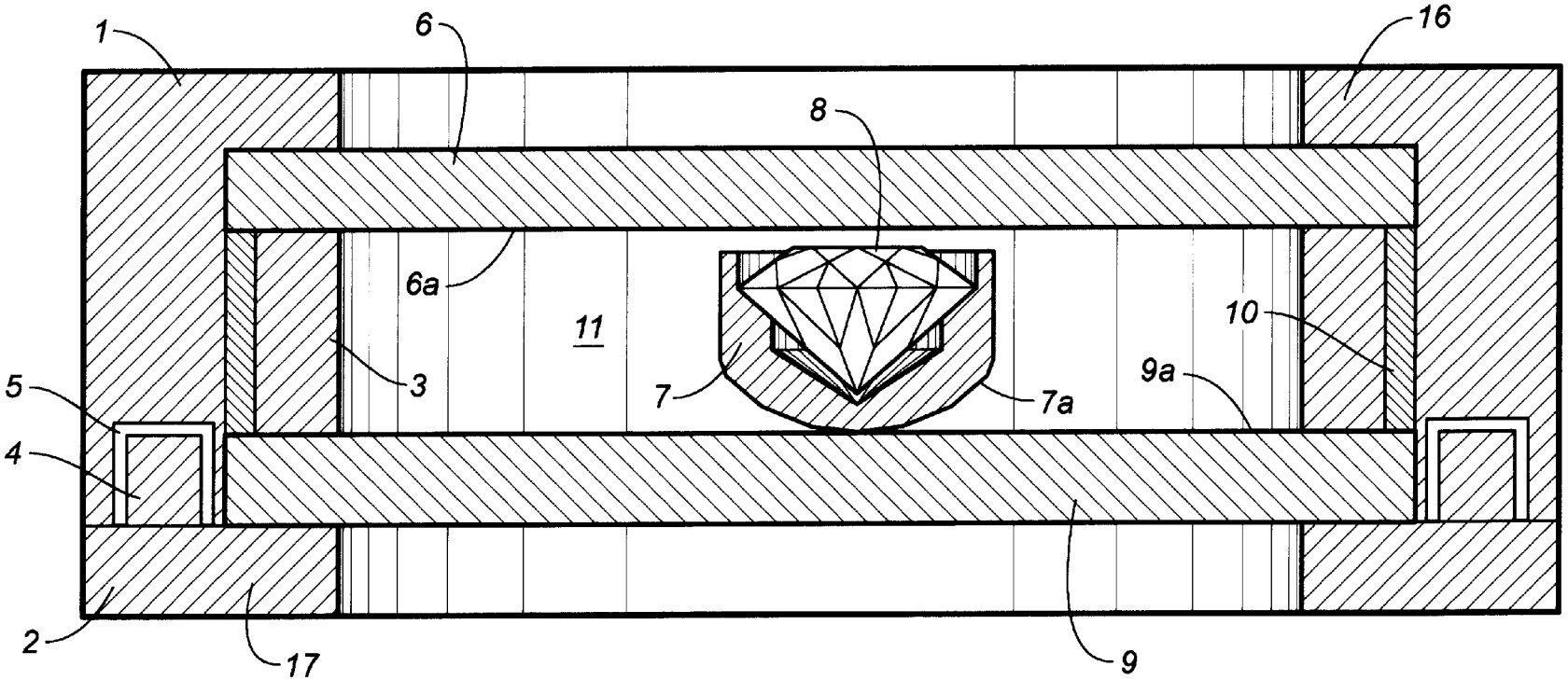
FIG. 2 is an elevation view of a display container containing a precious or semi-precious stone pinned or nailed by a metal bearing.
Figure 3:
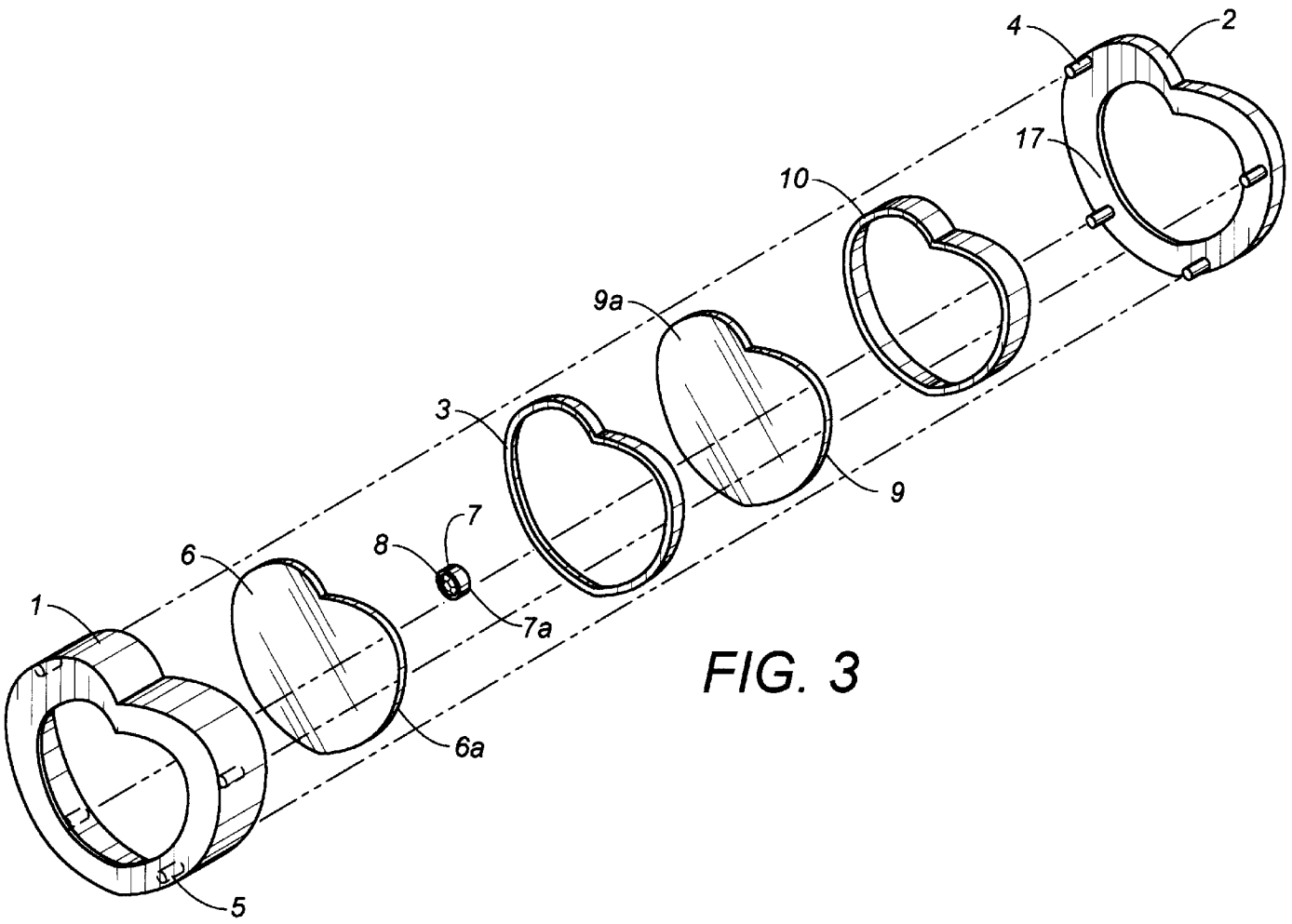
FIG. 3 is an exploded view of a heart-shaped display container and metal bearing.
Figure 4:
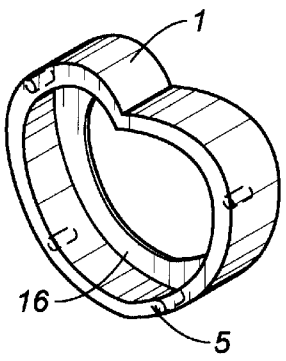
FIG. 4 is an isometric view of a heart-shaped display container.
Figure 5:
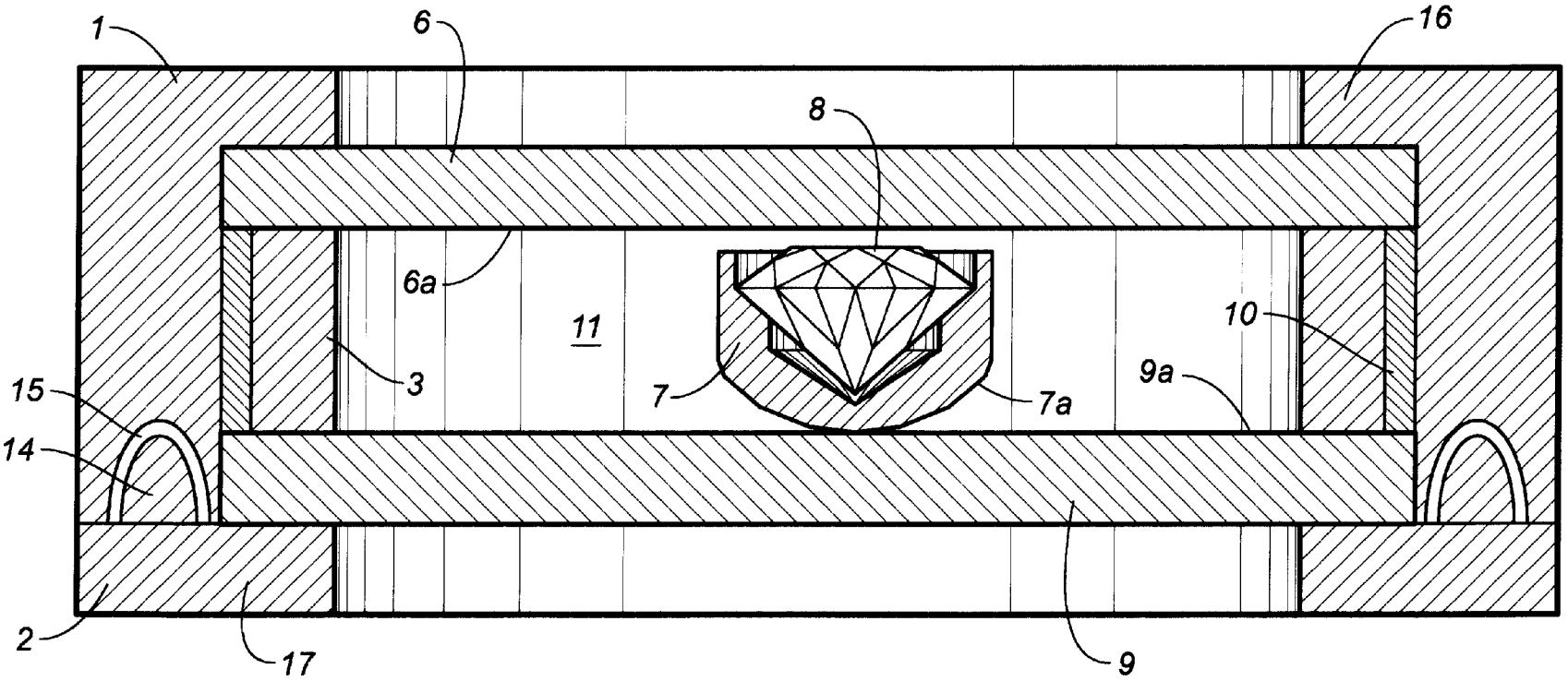
FIG. 5 is an elevation view of a display container containing a precious or semi-precious stone pinned or nailed by a metal bearing.
Figure 6:
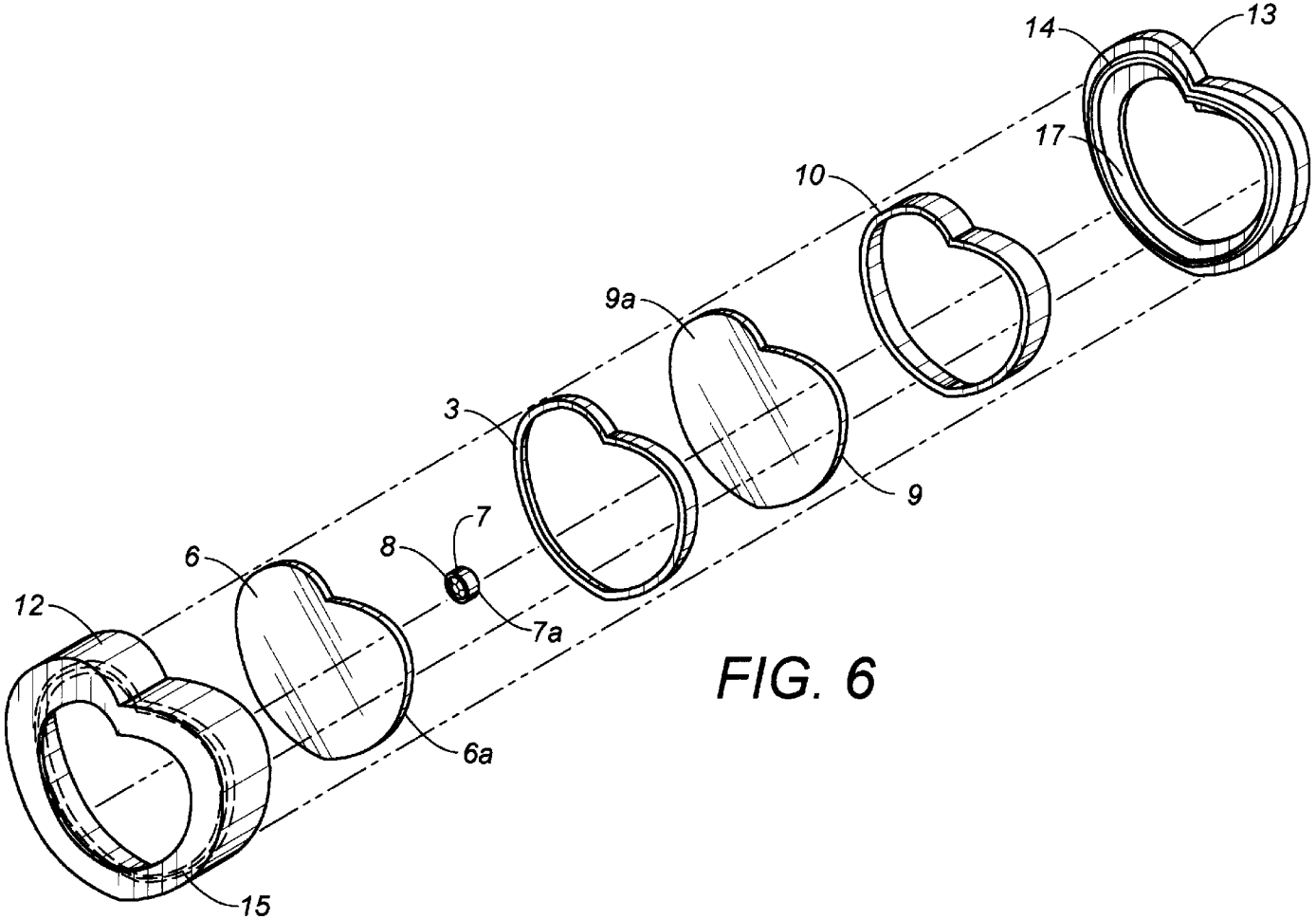
FIG. 6 is an exploded view of a heart-shaped display container and metal bearing.
Figure 7:
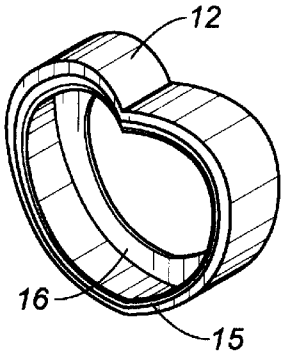
FIG. 7 is an isometric view of a heart-shaped display container.
Figure 8:
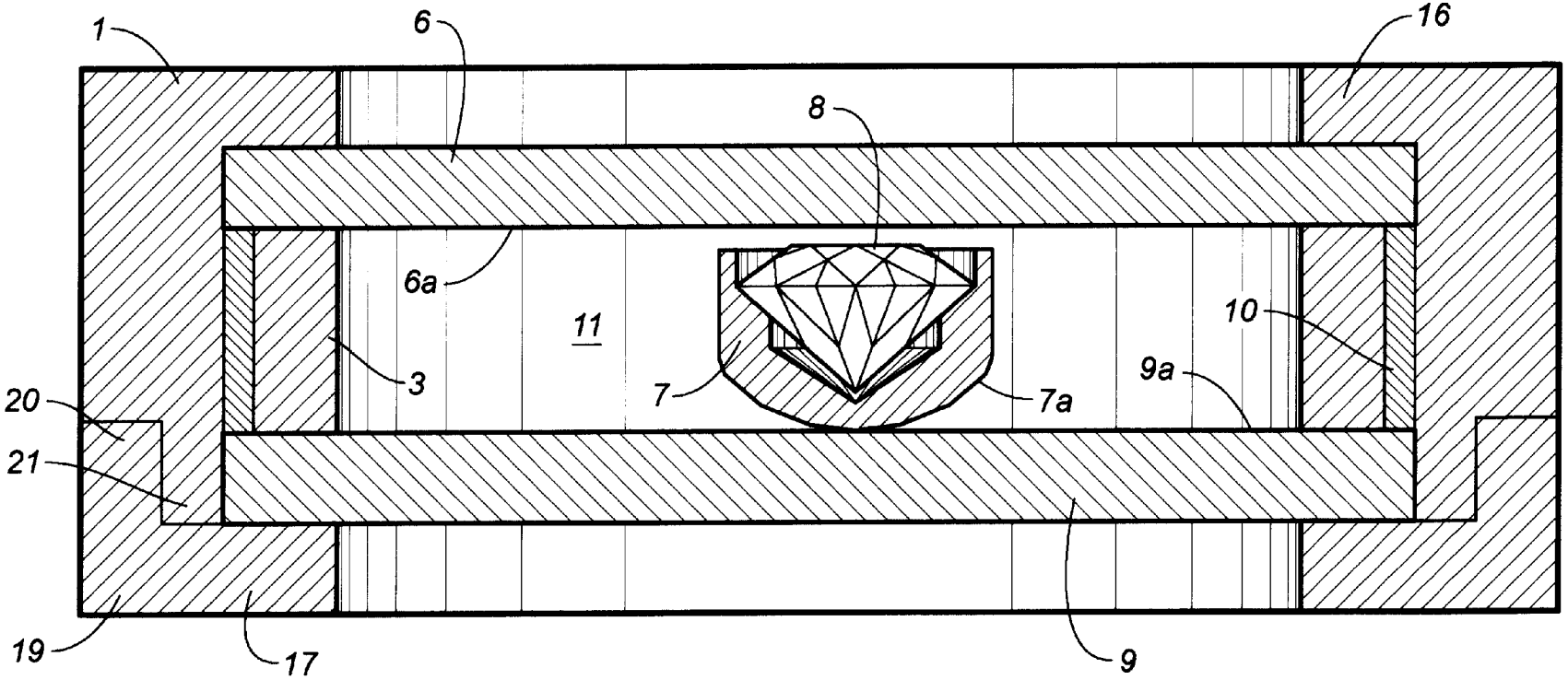
FIG. 8 is an elevation view of a display container containing a precious or semi-precious stone pinned or nailed by a metal bearing.
Figure 9:
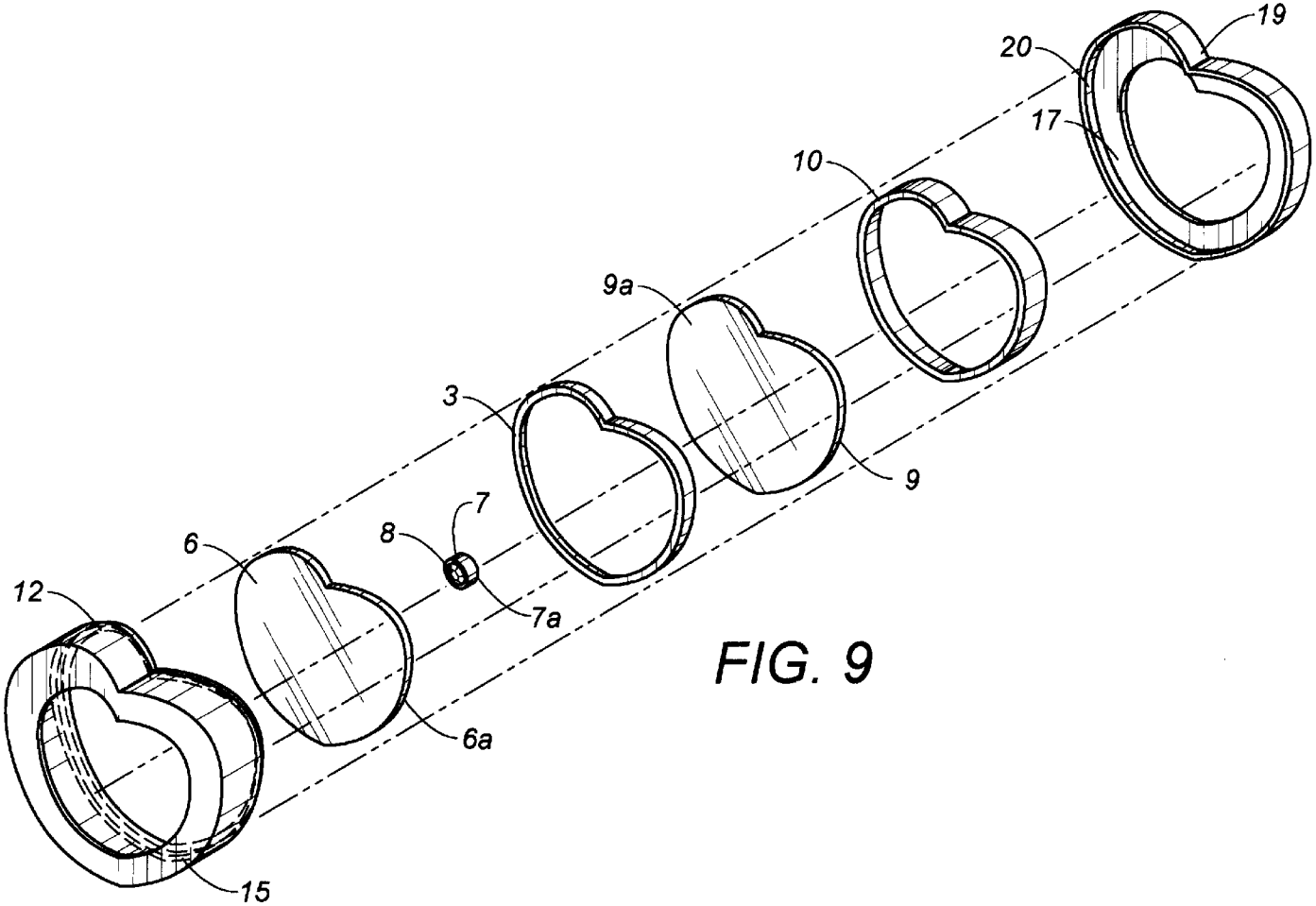
FIG. 9 is an exploded view of a heart-shaped display container and metal bearing.
Figure 10:
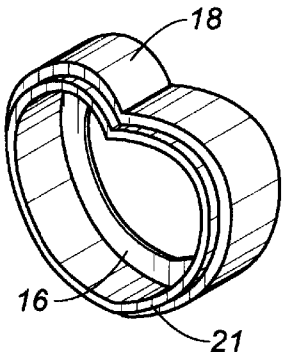
FIG. 10 is an isometric view of a heart-shaped display container.

In FIG. 1, a metal bearing containing a pinned or nailed precious or semi-precious stone (8) is illustrated. In a preferred embodiment of the present invention, the metal bearing (7) shown in FIG. 1 has a cup shape including an open cavity front surface having a maximum width, sidewalls, a rounded, facetted exterior lower surface **(7*a*), and a bearing height. As illustrated in FIG. 2, in a preferred embodiment of the present invention system and method, at least one stone containing metal bearing (7) is contained in a display container that includes an outer body (1), a back cover (2), and a transparent front cover (6) located a distance (11) from the back cover (2). In a preferred embodiment, the distance (11) between the front (6) and back (2) covers is less than the maximum width across the open cavity front surface and greater than the bearing height thereby allowing the stone containing metal bearing (7) to tilt or lean from side to side within the display container without allowing the metal bearing (7) to roll completely over. Such a range of motion enhances the reflected light emanating from the stone (8) and the metal bearing (7) thereby enhancing the perceived brightness of the stone (8)**.

FIGS. 1–10 illustrate various elements and embodiments of the present invention. The following represents a list of the elements illustrated in FIGS. 1–10:

1. Outer body manufactured in various designs (1);
2. Back cover manufactured in various designs (2);
3. Metal piece (11) adjusting the height between two glasses or one glass and one metal (3);
4. Centering and fixing pins for back cover (4);
5. Holes, where pins of back cover located at the outer body, are inserted (5);
6. Upper glass or upper sapphire crystal ensuring transparency of inner surface (6);
7. Inner surface of upper glass and upper sapphire crystal (6A);
8. Metal piece, where precious or semi-precious stone is nailed, and rotating between two glasses or one glass and one metal (7);
9. Facetted lower surface, which ensures oscillating leaning of metal piece, where precious or semi-precious stone is nailed, to each side, while it is rotating between two glasses (7A);
10. Precious or semi-precious stone, which is nailed to a metal piece rotated between two glasses or one glass and one metal (8);
11. Lower glass, sapphire crystal or metal piece (9);
12. Inner surface of lower glass, sapphire crystal or metal piece (9A);
13. Seal, which has waterproof and adhering characteristics and resistant to determined temperatures (10);
14. Clearance adjusted according to metal pieces, where precious stone is nailed, and height between two glasses, sapphire crystal or one glass and one metal (11);

15. Outer body, which has centering and fixing (15) channel manufactured in various designs (12);
16. Back cover, which has centering and fixing (14) projecting part manufactured in various designs (13);
17. Back cover centering and fixing channel (14);
18. Outer body centering and fixing channel (15);
19. Border frame framing borders of glass or sapphire crystal located on the outer body (16);
20. Border frame framing borders of glass, sapphire crystal or metal piece located on the back cover (16);
21. Outer body, which has centering and fixing (21) projecting part manufactured in various designs (18);
22. Back cover, which has centering and fixing hollow (22) manufactured in various designs (19);
23. Back cover centering and fixing hollow (20); and
24. Outer body centering and fixing projecting part (21).

This invention can be applied to a wide range of products and designs. According to this, centering and fixing system display container can be achieved by inserting of pins (4) located on back cover (2) to hollows (5) on outer body (1), or by inserting of projecting part (14) located on back cover (13) to channel (15) on outer body (12), or inserting of female piece (20) located at the edge of back cover (19) to male part (21) on outer body (18).

In the invention, upper glass (6) manufactured in convenient design for outer body (1, 12, 18) shall be placed inside of sapphire crystal outer body by placing it to outer body frame (16) from inside. One or more metal bearings (7, 7A–8), containing nailed or pinned precious or semi-precious stones, can be placed [one or more than one] in the display container. Piece (3) constituting height (11) between two glasses, two sapphire crystal, one glass one metal or one sapphire crystal one metal piece is fixed, and then glass (9), sapphire crystal or metal piece is placed on it, and seal (10), which is waterproof, adhesive and resistant to temperature, is placed. At the end, back cover manufactured in various designs (2, 13, 19) is placed with a special adhesive agent, and assemblage is completed.

Invention increases brightening of a precious stone moved between two glasses, while stones nailed or pinned by metal bearings are moving and rotating.

a) Due to heights of moving stone between two glasses and nailed metal pieces, and this space between two glasses in the period of rotating, precious stone ensures leaning of metal piece to each side. This increases brightening of precious stone.

b) In addition to leaning space of precious stone and nailed metal piece moving between two glasses, precious stone is manufactured as facetted like diamond cut of lower floor of nailed metal pieces, this facetted surface significantly increases brightening of brilliant when vibrating leaning movement to each side is achieved for precious stone and nailed metal pieces, which has ability to lean to each side, through facings of bottom laver.

c) It has protective outer frame for glasses against external impacts and it has eliminate falling down of frame glass due to any reason and loosing of precious or semi-precious stones in glass.

d) Invention protects the factory clearance between two glasses due to its waterproof characteristic. Therefore, clear mould brightening feature can be protected as its firstly manufactured, and after usage it can be polished, grinned and washed with ultrasonic lights again. With this it can be used always very clearly.

The invention has been described in detail while making reference to specific embodiments thereof. However, since it is known that others skilled in the art will, upon learning of the invention, readily visualize yet other embodiments of the invention that are within the spirit and scope of the invention, it is not intended that the above description be taken as a limitation on the spirit and scope of this invention.

What is claimed is:

1. A display system for enhancing the brightness of precious or semi-precious stones, said system comprising:

(a) a display container for displaying stones, said container including multiple surfaces including a top surface and a bottom surface, at least said top surface being transparent;

(b) at least one metal bearing contained within said container, said bearing including multiple surfaces including a top surface and a bottom surface, at least said bottom surface of said metal bearing being facetted, said top surface of said metal bearing adapted to receive and retain a stone; and (c) at least one stone pinned by said at least one metal bearing.

2. The display system of claim 1, wherein said metal bearing and said container are adapted to allow said stone and said metal bearing to tilt from side to side within said container between said container top and bottom surfaces while maintaining said stone in a position adjacent to said container top surface and preventing said metal bearing bottom surface from contacting said container top surface.

3. The display system of claim 1, wherein said display container includes a waterproof seal.

4. The display system of claim 1, wherein said display container includes at least one metal surface.

* * * * *